US008014692B2

(12) United States Patent
Furushige

(10) Patent No.: US 8,014,692 B2
(45) Date of Patent: Sep. 6, 2011

(54) IMAGE FORMING APPARATUS

(75) Inventor: Katsuji Furushige, Osaka (JP)

(73) Assignee: Kyocera Mita Corporation (JP)

( * ) Notice: Subject to any disclaimer, the term of this patent is extended or adjusted under 35 U.S.C. 154(b) by 577 days.

(21) Appl. No.: 11/728,786

(22) Filed: Mar. 27, 2007

(65) Prior Publication Data

US 2007/0248372 A1 Oct. 25, 2007

(30) Foreign Application Priority Data

Apr. 19, 2006 (JP) ..... 2006-116006
Apr. 19, 2006 (JP) ..... 2006-116007

(51) Int. Cl.
*G03G 21/00* (2006.01)
*B65H 17/18* (2006.01)
*B41J 2/385* (2006.01)
*B41J 15/00* (2006.01)

(52) U.S. Cl. ..... 399/75; 399/81; 399/82; 399/391; 399/394; 399/77; 271/25; 271/226; 271/227; 271/258.01; 347/116; 347/258; 400/578; 400/594.1

(58) Field of Classification Search ..... 399/75, 399/76, 77, 81, 82, 366, 388, 391, 394; 271/3.06, 271/25, 226, 227; 400/478, 594
See application file for complete search history.

(56) References Cited

U.S. PATENT DOCUMENTS 6,014,542 A * 1/2000 Hozumi et al. ..... 399/394
6,201,944 B1 3/2001 Onuki et al.
6,236,450 B1 * 5/2001 Ogura ..... 355/407
6,975,819 B2 * 12/2005 Katamoto ..... 399/82
7,095,977 B2 * 8/2006 Nakamura ..... 399/396
7,110,017 B2 * 9/2006 Yoshino et al. ..... 347/249
7,164,873 B2 * 1/2007 Yamamoto et al. ..... 399/82
7,457,550 B2 * 11/2008 Shoji et al. ..... 399/9
2005/0104282 A1 * 5/2005 Mandai et al. ..... 271/227
2006/0017761 A1 * 1/2006 Matsuzawa et al. ..... 347/15
2006/0088344 A1 * 4/2006 Aikawa ..... 399/301
2006/0268023 A1 * 11/2006 Toyama et al. ..... 347/2
2007/0045943 A1 * 3/2007 Shibayama ..... 271/226
2007/0059059 A1 * 3/2007 Fujino ..... 399/329
2007/0081074 A1 * 4/2007 Okamura et al. ..... 347/256
2007/0253724 A1 * 11/2007 Furushige ..... 399/75

FOREIGN PATENT DOCUMENTS

JP 2000233839 8/2000
JP 2001-296785 10/2001
JP 2002-333780 11/2002
JP 2003131149 5/2003
JP 2004-13039 1/2004
JP 2005070197 3/2005
JP 2006-251619 9/2006

* cited by examiner

*Primary Examiner* — David M Gray
*Assistant Examiner* — Francis Gray
(74) *Attorney, Agent, or Firm* — Gerald E. Hespos; Michael J. Porco

(57) ABSTRACT

When an instruction reception section receives an image forming instruction from an operator, a detector detects an toner image forming unit which performs an image forming operation in connection with the operator's instruction. A mode determining section determines which one of an image formation preceding mode or a sheet conveyance preceding mode is set for the toner image forming unit detected by the detector, and a drive controller controls drivings of the sheet conveying section and the image forming section according to the determined mode.

6 Claims, 5 Drawing Sheets

IMAGE FORMING APPARATUS

BACKGROUND OF THE INVENTION

1. Field of the Invention

The present invention relates to an image forming apparatus. More particularly, it relates to an image forming processing.

2. Description of the Related Art

Conventionally, in an image forming apparatus provided with toner image forming units for respective colors arranged along an image bearing member for color printing, a distance and a time length from starting of image formation performed by each toner image forming unit to completion of transferring a formed toner image to a recording sheet becomes long. Accordingly, in aim of shortening a printing time, it is controlled to start forming a toner image at a timing earlier than a start timing of feeding a recording sheet from a sheet feeding cassette. In the image forming apparatus which performs such control, when a toner image comes earlier than a recording sheet to a position where the toner image is transferred to the recording sheet, the toner image is disposed of, and then another toner image is formed and transferred to the recording sheet. Accordingly, toner particles are wasted when an arrival of a recording sheet to the toner image transferring position is delayed. In view of this, in an image forming apparatus disclosed in Japanese Unexamined Patent Publication No. 2004-13039, a delay in conveyance of a recording sheet is detected precociously. Then, an image formation performed by an image forming section is suspended immediately when the delay in conveyance is detected, and an arrival of the recording sheet is waited. Accordingly, an untransferred toner image to be discarded is prevented from being generated so that waste of toner particles is eliminated.

In the case of the image forming apparatus disclosed in the above-referenced patent publication, the waste of toner particles can be prevented. However, since the image formation performed by the image forming section is temporarily suspended when a delay in conveyance of the recording sheet is detected, it requires a long period of time to restart the image formation and complete the transfer of a toner image to the recording sheet.

SUMMARY OF THE INVENTION

The present invention was worked out to solve the above-described problem. Its object is to provide an image forming apparatus which reduces the amount of waste toner particles and shortens a printing time.

More specifically, the invention includes an image forming apparatus comprising: a sheet storage section for storing recording sheets; a sheet feeder for taking out and conveying a recording sheet from the sheet storage section; an image forming section including: a plurality of toner image forming devices for forming a monochromatic and color toner image, the toner image forming devices facing an image bearing member; the image bearing member for bearing a formed toner image transferred from a toner image forming device; and a transferring device for transferring the toner image formed on the image bearing member to a recording sheet conveyed by the sheet feeder; a drive controller for controlling drivings of the sheet feeder and the image forming section; an instruction reception section for allowing an operator to selectively instruct forming of a toner image on a recording sheet; a mode storing section for storing an image formation preceding mode of making the toner image forming devices start their respective toner image forming operations before the sheet feeder performs conveyance of a recording sheet from the sheet storage section, and a sheet conveyance preceding mode of making the toner image forming devices start their respective image forming operations after the sheet feeder performs conveyance of a recording sheet from the sheet storage section; and a mode determining section for determining, based on which one of the plurality of image forming devices is driven according to an operator's instruction to the instruction reception section, one of the image formation preceding mode and the sheet conveyance preceding mode stored in the mode storing section. The drive controller controls the drivings of the sheet feeder and the image forming section according to the mode determined by the mode determining section.

In the invention, when the instruction receiving section receives an operator's image forming instruction, the mode determining section determines, based on which one of the plurality of image forming devices performs an image forming operation according to the image forming instruction, one of the image formation preceding mode and the sheet conveyance preceding mode as a mode to be set for each of the image forming devices. Therefore, based on a position where a toner image is transferred from the image forming device performing the image forming operation to the image bearing member, arrival timings of a toner image and a recording sheet to the position where the toner image is transferred from the image bearing member to the recording sheet can be adjusted to an arrival timing which is efficient in terms of time and does not cause either the toner image or the recording sheet to generate a waiting time for transfer. For example, if a toner image formation and a sheet conveyance are started at the same time, when it is assumed that the toner image arrives at the transferring position in advance in view of the setting position of an image forming device which performs the image formation, the recording sheet preceding mode is set so that a delay in arrival of the recording sheet to the transferring position can be prevented. Accordingly, reduction of waste toner images can be achieved. Further, when it is assumed that the recording sheet arrives at the transferring position in advance in view of a setting position of an image forming device which performs the image formation, the image formation preceding mode can be set. Accordingly, the time period from the start of the image forming operation to the completion of transferring the toner image to the recording sheet can be shortened.

These and other objects, features and advantages of the present invention will become more apparent upon reading of the following detailed description along with the accompanied drawings.

DETAILED DESCRIPTION OF THE PREFERRED EMBODIMENTS

Figure 1:
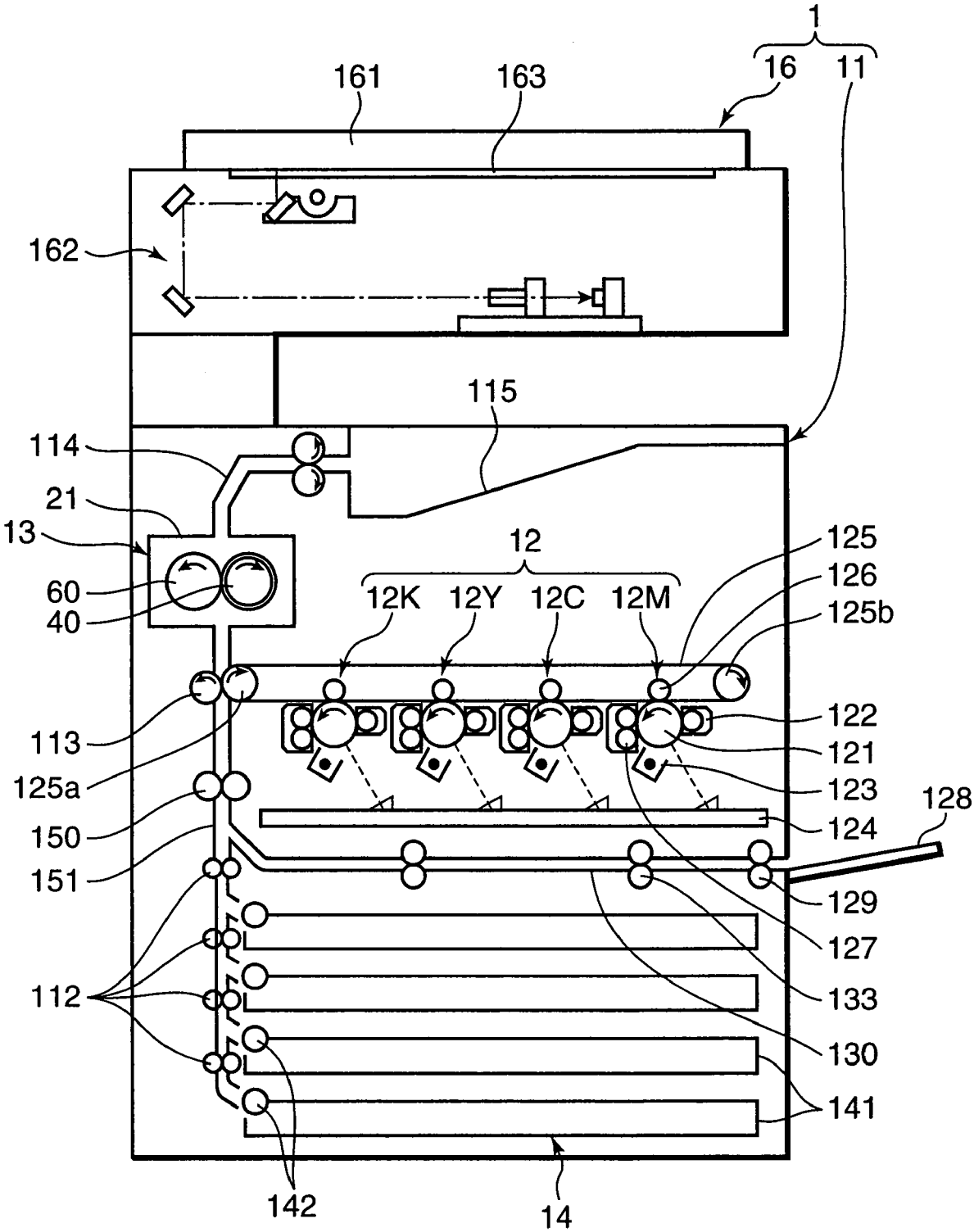
FIG. 1 is a front sectional view showing a schematic internal configuration of an image forming apparatus.

Hereinafter, an image forming apparatus according to an embodiment of the present invention will be described with reference to the drawings. FIG. 1 is a front sectional view showing a schematic internal configuration of the image forming apparatus. As shown in FIG. 1, a complex machine 1 embodying the image forming apparatus according to the present invention functions as a copying machine, a printer and a facsimile machine for color printing and includes an apparatus main body 11 and an image reading device 16. The apparatus main body 11 has a box-like shape which is called a middle-discharging type. The image reading device 16 is provided on an upper portion of the apparatus main body 11 and adapted for reading a document image.

In the apparatus main body 11, there are provided an image forming section 12, a fixing device 13 and a sheet storage section 14. The image forming section 12 is adapted for forming an image based on image information of a document read out by the image reading device 16. The fixing device 13 is adapted for performing a fixing processing to an image which is formed by the image forming section 12 and transferred to a recording sheet (transferred material) P. The sheet storage section 14 is adapted for storing a recording sheet onto which an image is to be transferred.

The image reading device 16 is provided with a document pressing member 161 and an optical image forming unit 162. The document pressing member 161 is provided on an upper surface of the apparatus main body 11 and can be opened and closed. The optical image forming unit 162 is provided so as to face the document pressing member 161 through a contact glass 163 in an upper portion in the housing of the apparatus main body 11. The contact glass 163 is formed to be a plate-like shape having a size slightly smaller than the document pressing member 161 to read out a surface of a document placed thereon. The document pressing member 161 can be opened or closed by forward and backward rotations about a predetermined shaft provided on one side of an upper surface of the housing which is a component of the image reading device 16.

In a predetermined portion of the image reading device 16, there is provided an unillustrated operation panel for allowing an operator to input conditions related to reading of a document, processing of copying and the like. The operation panel is provided with a display panel, numerical keys, a start button, a mode switching key and the like which are not illustrated in the drawing.

The optical image forming unit 162 includes a light source, a plurality of mirrors, a lens image forming unit, a CCD (charge coupled device) and the like, all of which are not illustrated in the drawing. A light ray irradiated from the light source is reflected from the document surface, and the reflected light ray is inputted as document information to the CCD through the mirrors and a lens image forming unit. Document information inputted to the CCD in a form of an analog quantity is converted to a digital signal and stored in a predetermined storage device.

The image forming section 12 is adapted for forming a toner image on a recording sheet conveyed from the sheet storage section 14. In the present embodiment, toner image forming units for respective colors are provided and arranged from the upstream side (right side in a drawing sheet of FIG. 1) to the downstream side in orders of a magenta toner image forming unit 12M, a cyan toner image forming unit 12C, a yellow toner image forming unit 12Y, a black toner image forming unit 12K. Further, a secondary transferring device (roller) 113 is provided.

Each of the toner image forming units 12M, 12C, 12Y, 12K is provided with a photoconductive drum 121 and a developing device 122. The photoconductive drum 121 receives a supply of toner particles from a corresponding developing device 122 while being rotated in a counter-clockwise direction in FIG. 1. Toner particles are supplied to the developing device 122 from an unillustrated toner cartridge provided on a front surface side (surface side of the sheet of FIG. 1) of the apparatus main body 11.

At the immediate beneath position from each photoconductive drum 121, there is provided a charging device 123. In the lower side from the charging device 123, there is provided an exposing device 124. The exposing device 124 performs an exposing operation with respect to the photoconductive drums 121 for respective colors. The peripheral surface of each photoconductive drum 121 is uniformly charged with electricity by the charging device 123. Laser light rays corresponding to respective colors based on image data inputted to the image reading device 16 are irradiated from the exposing device 124 to the respective peripheral surfaces of the photoconductive drums 121, each charged with electricity. Accordingly, an electrostatic latent image is formed on the peripheral surface of each photoconductive drum 121. Then, toner particles are supplied from the developing device 122 onto the electrostatic latent image so that a toner image is formed on the peripheral surface of each photoconductive drum 121.

At an upper position from each photoconductive drum 121, there is provided an intermediate transferring belt 125. The transferring belt 125 comes in contact with the respective peripheral surfaces of the photoconductive drums 121. The intermediate transferring belt 125 is stretchingly provided between a driving roller 125*a* and a driven roller 125*b*. The intermediate transferring belt 125 is pressed onto the respective peripheral surfaces of the photoconductive drums 121 by transferring rollers 126 provided correspondingly to the respective photoconductive drums 121. The intermediate transferring belt 125 is rotated between the driving roller 125*a* and the driven roller 125 while being synchronized with the photoconductive drums 121.

When a color image formation is performed, the intermediate transferring belt 125 is rotated. The photoconductive drum 121 of the magenta toner image forming unit 12M transfers a magenta toner image to the surface of the intermediate transferring belt 125. Next, the photoconductive drum 121 of the cyan toner image forming unit 12C superimposedly transfers a cyan toner image to the same position with the magenta toner image on the intermediate transferring belt 125. Next, the photoconductive drum 121 of the yellow cyan toner image forming unit 12Y superimposedly transfers a yellow toner image to the same position on the intermediate transfer belt 125. Finally, the photoconductive drum 121 of the black toner image forming unit 12K superimposedly transfers a black toner image. Accordingly, a color toner image is formed on the surface of the intermediate transferring belt 125. The secondary transferring device 113 (example of the transferring device in the claim) transfers the color toner image formed on the surface of the intermediate transferring belt 125 to a recording sheet P conveyed from the sheet storage section 14.

On the other hand, when a monochromatic image formation is performed, only a black toner image is transferred to the intermediate transferring belt 125 by the photoconductive drum 121 of the black color toner image forming unit 12K. Then, the secondary transferring device 113 transfers the black toner image formed on the surface of the intermediate transferring belt 125 to a recording sheet P conveyed from the sheet storage section 14.

In the left side position in FIG. 1 of each photoconductive drum 121, a cleaning device 127 is provided for removing residual toner particles to clean the peripheral surface of the photoconductive drum 121. The peripheral surface of the photoconductive drum 121 cleaned by the cleaning device 127 moves toward the charging device 123 for the next charging processing.

The toner particles removed from the peripheral surface of the photoconductive drum 121 by the cleaning device 127 are collected and stored in an unillustrated toner collection bottle through a predetermined passage.

In the left side position in FIG. 1 of the image forming section 12, there is formed a sheet conveying passage 151 extending in a vertical direction. In the sheet conveying passage 151, there is provided a pair of conveying rollers 112 at a predetermined portion. A recording sheet from the sheet storage section 14 is conveyed by a driving of the pair of conveying rollers 112 toward the intermediate transferring belt 125 hung around the driving roller 125*a*. In the sheet conveying passage 151, there is provided the secondary transferring device 113 which comes in contact with the surface of the intermediate transferring belt 125 at a position of facing the driving roller 125*a*. A recording sheet P being conveyed in the sheet conveying passage 151 is pressed and nipped by the intermediate transferring belt 125 and the secondary transferring device 113. Accordingly, a toner image formed on the intermediate transferring belt 125 is transferred to the recording sheet P. A peripheral speed of the driving roller 125*a* which is rotationally driven (running speed of the intermediate transferring belt 125) and a peripheral speed of the secondary transferring device 113 which is rotationally driven are set to be the same. Further, a recording sheet conveying speed of the pair of conveying rollers 112 and a registration roller (registration device) 150 and a recording sheet conveying speed of the driving roller 125*a* and the secondary transferring device 113 nipping the recording sheet P are set to be the same.

The fixing device 13 is adapted for applying a fixing processing to a toner image transferred to a recording sheet by the secondary transferring device 113. The fixing device 13 includes a heating roller 30 and a pressing roller 40. The heating roller 30 has a halogen lamp inside which is an electric heating body serving as a heating source. The pressing roller 40 is located so as to face the heating roller 30 and comes in contact with the heating roller 30 while applying a predetermined pressure. After the fixing processing is completed, the recording sheet P passes through a sheet discharging passage 114 extending from an upper portion of the fixing device 13 and is discharged to a middle-discharging tray 115.

The sheet storage section 14 includes a plurality of sheet feeding cassettes (sheet storage portions) 141 each detachably mounted in a lower side position from the disposing device 124 in the apparatus main body 11. A stack of recording sheets are stored in the sheet feeding cassette 141. Recording sheets P are taken out one after another from the stack of recording sheets by a driving of the pickup roller 142. The recording sheet taken out from the stack passes through the sheet conveying passage 151 and is conveyed to a nipping portion between the secondary transferring device 113 and the intermediate transferring belt 125 of the image forming section 12.

On one side portion of the apparatus main body 11, there is provided a manual feeding tray (sheet storage portion) 128. A recording sheet placed on the manual feeding tray 128 is taken inside the apparatus main body 11 by the pair of conveying rollers 129, conveyed through the manually fed sheet conveying passage 130 by pair of conveying rollers 133, and conveyed to a nipping portion between the secondary transferring device 113 and the intermediate transferring belt 125 by the registration roller 150.

Figure 2:
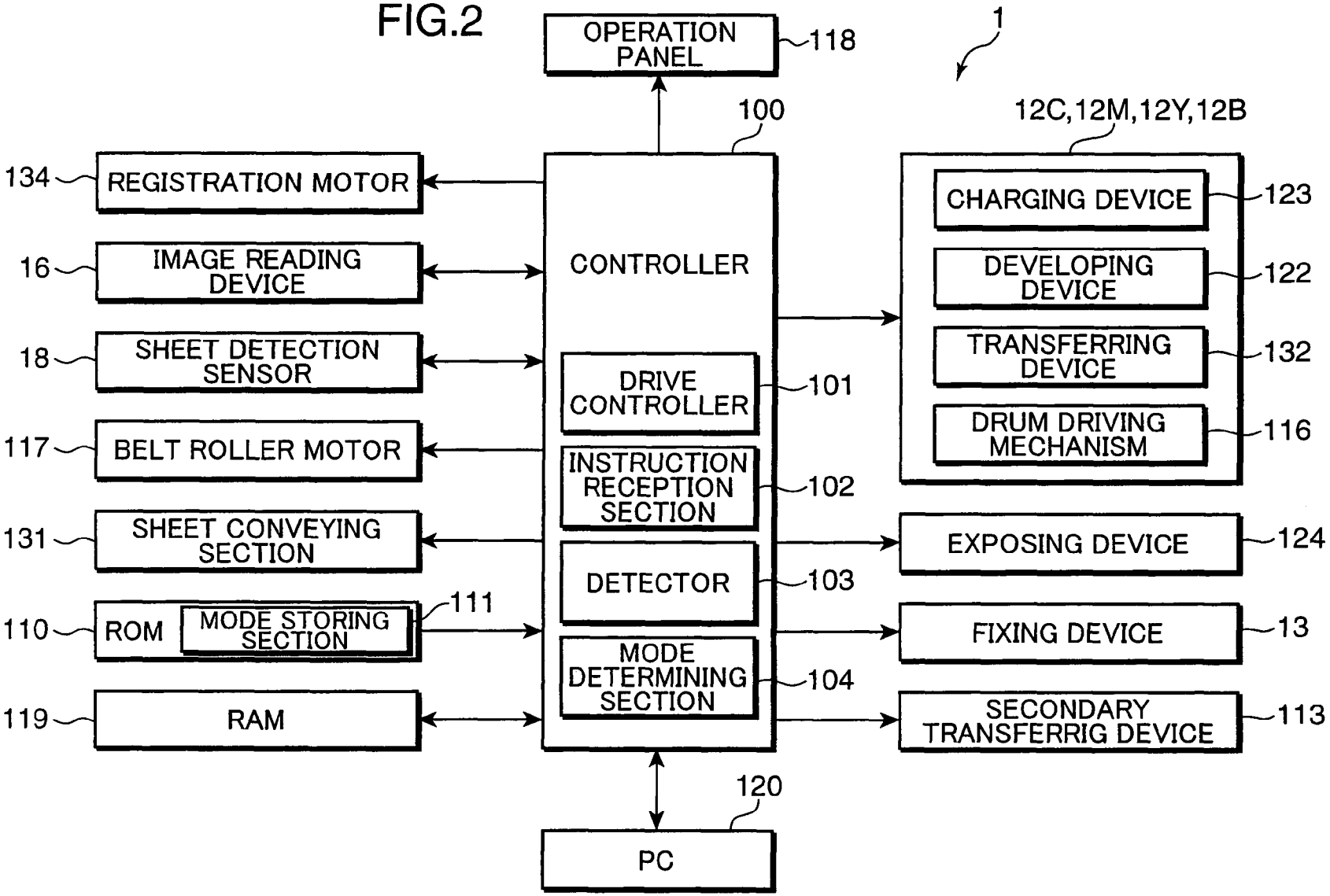
FIG. 2 is a block diagram showing an example of a schematic electric configuration of a complex machine.

FIG. 2 is a block diagram showing an example of a schematic electric construction of the complex machine 1. The complex machine 1 is provided with a controller 100 which totally controls the complex machine 1. The controller 100 is connected with a ROM 110 and a RAM 119. The ROM 110 stores a program and the like for controlling the apparatus. The RAM 119 temporarily stores image data and the like and functions as a working area.

The ROM 110 includes a mode storing section 111 which stores any one of an image formation preceding mode or a sheet conveyance preceding mode set for each of the plurality of toner image forming units 12C, 12M, 12Y, 12K. The image formation preceding mode is a mode of making the toner image forming units 12C, 12M, 12Y, 12K and the exposing device 124 start their respective toner image forming operations before the sheet conveying section (sheet feeder) 131 performs conveyance of a recording sheet from the sheet feeding cassette 141. The sheet conveyance preceding mode is a mode of making the sheet conveying section 131 perform conveyance of a recording sheet from the cassette 141 before the toner image forming units 12C, 12M, 12Y, 12K and the exposing device 124 start their respective toner image forming operations.

The image forming operation preceding mode includes the case of starting an image forming operation before the sheet feeding operation by making the image forming operation be started before a recording sheet is conveyed by the sheet conveying section 131 to a predetermined position on the sheet conveying passage 151 and upstream in a recording sheet conveying direction with respect to a toner image transferring position of the secondary transferring device 113.

Further, the sheet conveyance preceding mode includes the case of starting the sheet feeding operation before the image forming operation by making the image forming operation be started after a recording sheet is conveyed by the sheet conveying section 131 to a predetermined position on the sheet conveying passage 151 and upstream in the recording sheet conveying direction with respect to the toner image transferring position of the secondary transferring device 113.

A mode setting for each of the toner image forming units will be described. According to the mode setting, when a distance A from an image forming unit detected by a detector 103 to the toner image transferring position of the secondary transferring device 113 (a distance from a nipping portion between the photoconductive drum 121 of the image forming unit detected by the detector 103 and the transferring roller 126 to the image transferring position of the secondary transferring device 113) is longer than a distance B from the sheet feeding cassette 141 to the image transferring position of the secondary transferring device 113 (a distance from a leading edge portion in a sheet conveying direction of a recording sheet stored in the sheet feeding cassette 141 to the toner image transferring position of the secondary transferring device 113), the image formation preceding mode is set for the image forming unit.

Further, when a distance A from an image forming unit detected by the detector 103 to the toner image transferring position of the secondary transferring device 113 is shorter than a distance B from the sheet feeding cassette 141 to the toner image transferring position of the secondary transferring device 113, the sheet conveyance preceding mode is set for the image forming unit.

When an image formation mode is set for each of the image forming units based on a relationship between a distance A and a distance B of each of the image forming units as described above, the following effects can be achieved. As described above, in the complex machine 1, a peripheral speed of the driving roller 125*a* (a running speed of the intermediate transferring belt 125) and a peripheral speed of the secondary transferring device 113 are set to be the same. Further, a recording sheet conveying speed of the pair of conveying rollers 112 and the registration roller 150 is set to be the same speed as of a recording sheet conveying speed of the driving roller 125*a* and the secondary transferring device 113 nipping the recording sheet P. Therefore, when the image formation and the sheet feeding are performed at the same time under the aforementioned condition, it is determined whether the sheet feeding is started in advance or the image formation is started in advance, based on which one of a toner image transferred from each image forming unit to the intermediate transferring belt 125 and a recording sheet conveyed by the sheet conveying section 131 reaches the toner image transferring position earlier. Accordingly, the toner image formed on the intermediate transferring belt 125 and the recording sheet conveyed by the sheet conveying section 131 can be arrived at the same time at the toner image transferring position of the secondary transferring device 113. Consequently, both shortening of a time required for completing a toner image transferring operation to a recording sheet and a reduction of a waste toner amount can be achieved.

Further, the controller 100 is connected with the toner image forming units 12C, 12M, 12Y, 12K for respective colors. Each of the toner image forming units 12C, 12M, 12Y, 12K is provided with a charging device 123, a developing device 122, a transferring device 132 and a drum driving mechanism 116. The transferring device 132 applies a transfer bias voltage to the transferring roller 126 to transfer a toner image formed on the photoconductive drum 121 to the intermediate transferring belt 125. The drum driving mechanism 116 is a driving mechanism for driving the photoconductive drum 121. The drum driving mechanisms 116 for the respective toner image forming units 12C, 12M, 12Y, 12K may be provided with a single common driving source or a plurality of individual driving sources for respective units.

In FIG. 2, the toner image forming units for yellow, magenta, cyan and black are shown as a single toner image forming unit. However, the toner image forming units for respective colors are actually connected with the controller 100.

Further, the controller 100 controls the exposing device 124, the secondary transferring device 113 and the fixing device 13. Furthermore, the controller 100 controls a registration motor 134, a sheet detection sensor 18 and the image reading device 16. The registration motor 134 rotationally drives the registration roller 150 (FIG. 1).

Further, a belt roller motor 117, which is a driving source for the belt rollers 125*a*, 125*b*, for running the intermediate transferring belt 125 is also controlled by the controller 100. Furthermore, the controller 100 is connected with an operation panel 118 allowing an operator to input an instruction to a monochromatic image, a color image or the like, and connected with an external PC (personal computer) 120 via an interface 119. The complex machine 1 performs an image formation based on an image data inputted from the PC 120 or the like.

Further, the controller 100 is connected with the sheet conveying section 131. The sheet conveying section 131 conveys a recording sheet from the sheet feeding cassette 141 to the toner image transferring position where the intermediate transferring belt 125 (driving roller 125*a*) and the secondary transferring device 113 are provided, and discharges a recording sheet on which the toner image is transferred at this position to the middle-discharging tray 115.

Further, the controller 100 includes a drive controller 101, an instruction reception section 102, the detector 103 and a mode determining section 104. The drive controller 101 controls drivings of the sheet conveying section 131, the toner image forming units 12C, 12M, 12Y, 12K, the exposing device 124, the fixing device 13 and the secondary transferring device 113. Further, the drive controller 101 controls the sheet conveying section 131, the image forming units 12C, 12M, 12Y, 12K, the exposing device 124, the fixing device 13 and the secondary transferring device 113 in a mode determined by the mode determining section 104 (details are described hereinafter).

The instruction reception section 102 receives various operative instructions i.e. an instruction inputted by an operator through an operation of the operation panel 118 to form a toner image on a recording sheet. Further, when the complex machine 1 functions as a printer for printing data transmitted from an external personal computer, the instruction reception section 102 receives the image forming instruction from the personal computer. Furthermore, when the complex machine 1 functions as a facsimile machine, the instruction reception section 102 receives the image forming instruction from a facsimile machine which is a sender who transmits facsimile data.

The detector 103 detects, among the toner image forming units performing an image forming operation according to the image forming instruction, an image forming unit located at a position having a longest toner image moving distance to the secondary transferring device 113 on the moving course of the intermediate transferring belt 125. Further, the detector 103 detects whether an image forming instruction received by the instruction reception section 102 is an instruction for forming a monochromatic image or a color image. Furthermore, the detector 103 detects the sheet feeding cassette 141 or the manual feeding tray 128 used for the image formation.

The mode determining section 104 determines a mode set for an image forming unit detected by the detector 103, based on a mode set for each of the image forming units and stored in a mode storing section 111. Further, the mode determining section 104 determines to set the image formation preceding mode when the detector 103 detects a color image forming instruction. When the detector 103 detects a monochromatic image forming operation, the mode determining section 104 determines to set a recording sheet preceding mode.

Figure 3:
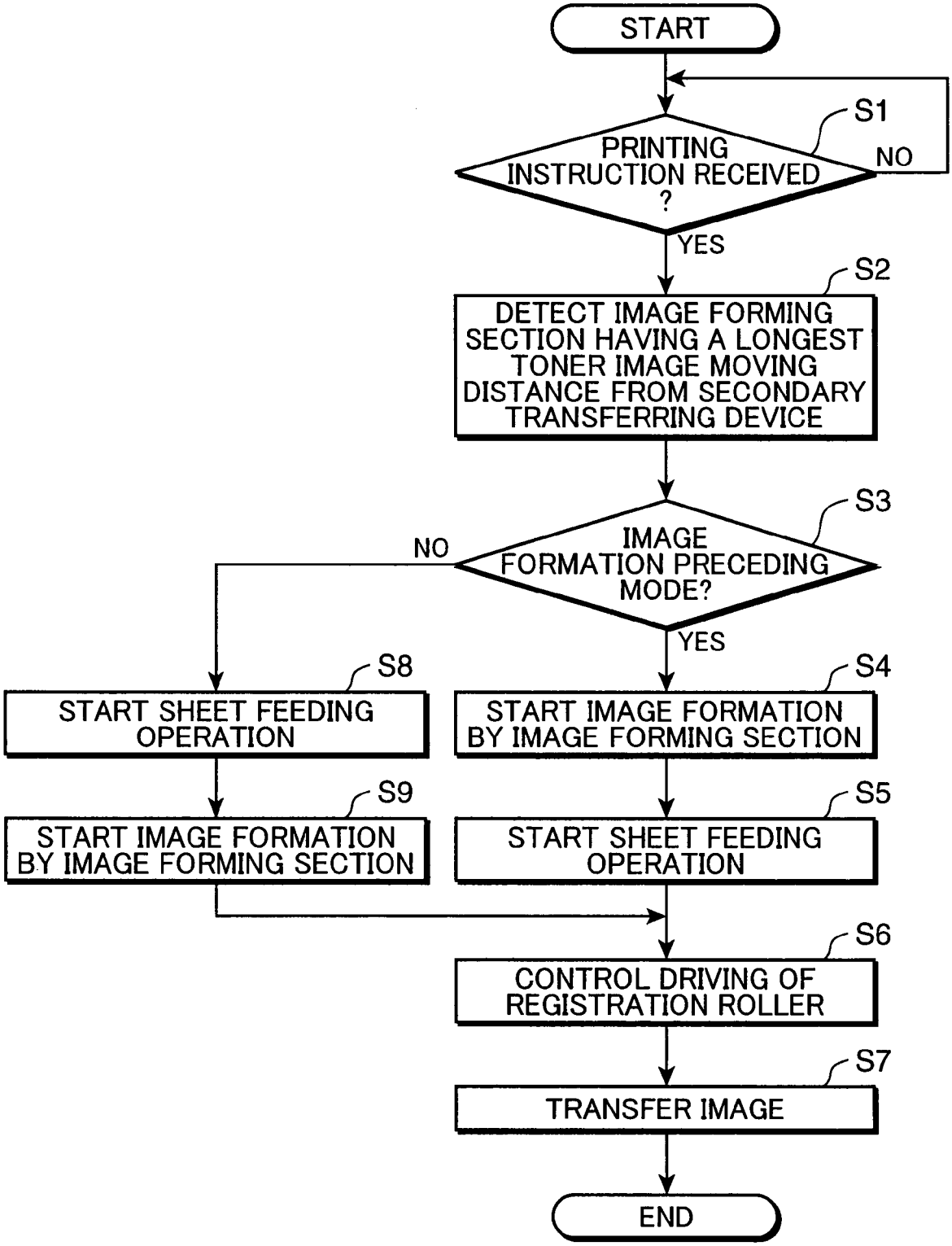
FIG. 3 is a flowchart showing an embodiment of an image forming processing performed by the complex machine.

FIG. 3 is a flowchart showing an embodiment of an image forming processing performed by the complex machine 1. In the complex machine 1, when the instruction reception section 102 receives a printing instruction through an operation of the operation panel 118 or the like by an operator (YES in S1), the detector 103 detects, among toner image forming units used for performing an image forming operation according to the image forming instruction, an image forming unit located at a position having a longest toner image moving distance to the secondary transferring device 113 on the moving course of intermediate transferring belt 125 (S2). Then, the mode determining section 104 determines the mode to be set for the image forming unit detected by the detector 103 based on the mode stored in the mode storing section 111 (S3). More specifically, the image formation mode set for the image forming unit detected by the detector 103 is read out from the mode storing section 111, and the read image formation mode is determined as an image formation mode according to the image formation based on the printing instruction.

The drive controller 101 controls each image forming unit which performs an image forming operation and the exposing device 124 to start performing the image formation before a recording sheet is fed from the sheet feeding cassette 141 by the sheet conveying section 131 (S4) when a mode determined by the mode determining section 104 (a mode set for an image forming unit located at a position having a longest toner image moving distance to the secondary transferring device 113 on the course of the intermediate transferring belt 125) is the image formation preceding mode (YES in S3). At the time when the image forming operation performed by the image forming unit and the exposing device 124 is proceeded to a predetermined step (assuming that a sheet feeding is started, at a timing when a toner image formed on the intermediate transferring belt 125 and a recording sheet conveyed by the sheet conveying section 131 arrives at the toner image transferring position of the secondary transferring device 113 at the same time and can be transferred), a sheet feeding operation from the sheet feeding cassette 141 by the sheet conveying section 131 is started (S5).

Further, the drive controller 101 controls the sheet conveying section 131 to start feeding a recording sheet from the sheet feeding cassette 141 before each toner image forming unit which performs an image forming operation and the exposing device 124 perform the image forming operation (S8) when a mode determined by the mode determining section 104 is the sheet conveyance preceding mode (NO in S3). At the time when a conveyance of a recording sheet from the sheet feeding cassette 141 is proceeded to a predetermined position (assuming that image formation by the toner image forming units and the exposing device 124 is started, at a timing when a toner image formed on the intermediate transferring belt 125 and a recording sheet conveyed by the sheet conveying section 131 arrives at the toner image transferring position of the secondary transferring device 113 at the same time and can be transferred), the image forming operation by each image forming unit and the exposing device 124 is started (S9).

In the embodiment, a toner image forming unit at a position having a longest toner image moving distance to the secondary transferring device 113 on the course of the intermediate transferring belt 125 indicates the black toner image forming unit 12K in the case of forming a monochromatic image. In the case of forming a color image, a toner image forming unit indicates the magenta toner image forming unit 12M (in the present embodiment, among the toner image forming units for respective colors, the magenta toner image forming unit 12M is at a position having a longest toner image moving distance to the secondary transferring device 113 on the course of the intermediate transferring belt 125). Further, in the case of forming a single color image (forming an image by using only one of the magenta toner image forming unit 12M, the cyan toner image forming unit 12C and the yellow toner image forming unit 12Y), a toner image forming unit indicates a toner image forming unit used for the image forming operation among the magenta toner image forming unit 12M, the cyan toner image forming unit 12C and the yellow toner image forming unit 12Y.

The drive controller 101 obtains positional information of a recording sheet on upstream in a sheet conveying direction from the registration roller 150 based on a sheet detection signal from a sheet detection sensor 18. When a recording sheet conveyed by the sheet conveying section 131 is conveyed to a proximity to the secondary transferring device 113 at a timing earlier than a toner image which started to be formed before the sheet feeding operation in S4, the drive controller 101 suspends the registration roller 150 to temporarily suspend a conveyance of a recording sheet at a position of the registration roller 150, thereby adjusting arrival timings of the recording sheet and the toner image to the toner image transferring position of the secondary transferring device 113 to be the same (S6).

After adjusting the timing, the drive controller 101 controls the registration motor 134 to rotate so as to convey the recording sheet to the secondary transferring device 113 by the registration roller 150, thereby making the secondary transferring device 113 transfer the toner image formed on the intermediate transferring belt 125 to a recording sheet (S7).

By performing such processing, a time period required for completing an image transfer to a recording sheet can be shortened, and an amount of waste toner particles can be reduced.

Figure 4:
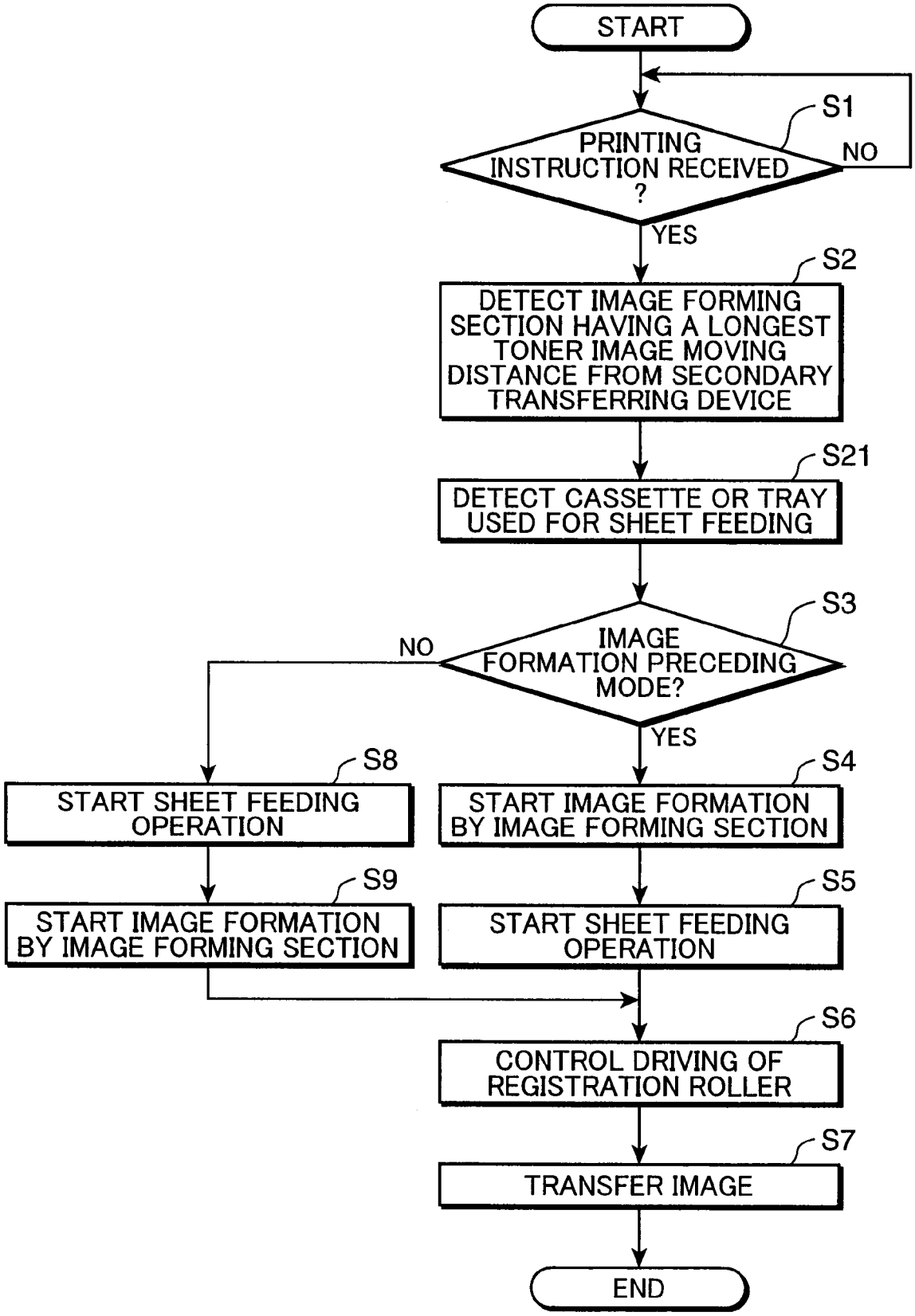
FIG. 4 is a flowchart showing another embodiment of the image forming processing performed by the complex machine.

FIG. 4 is a flowchart showing another embodiment of an image forming processing performed by the complex machine 1. In FIG. 4, descriptions regarding the processings which are same as those of the embodiment shown in FIG. 3 are omitted.

In the embodiment shown in FIG. 3, regardless of which one of the sheet feeding cassette 141 and the manual feeding tray 128 is used as a sheet feeding section for an image formation, a toner image forming unit which is located at a position having a longest toner image moving distance to the secondary transferring device 113 on the course of the intermediate transferring belt 125 is detected, and the complex machine 1 performs an image forming processing in a mode (image formation preceding mode or a sheet conveyance preceding mode) set for the toner image forming unit.

On the contrary, in another embodiment shown in FIG. 4, a mode set for each toner image forming unit is determined based on a distance relationship between a distance C from the sheet feeding cassette 141 or the manual feeding tray 128 used for an image formation to the toner image transferring position of the secondary transferring device 113 (a distance from a leading end in a sheet conveying direction of a recording sheet stored in the sheet feeding cassette 141 or placed on the manual feeding tray 128 to the toner image transferring position of the secondary transferring device 113) and a distance A from an toner image forming unit detected by the detector 103 to the toner image transferring position of the secondary transferring device 113, and stored in a mode storing section 111. In the configuration of the complex machine 1 shown in FIG. 1, a mode with respect to a toner image forming unit is set respectively according to which one of four sheet feeding cassettes 141 and the manual feeding tray 128 is used. In other words, in the complex machine 1 according to the present embodiment, five mode settings set for respective toner image forming units are stored in the mode storing section 111.

For example, when an toner image forming unit detected by the detector 103 is the magenta toner image forming unit 12M (S2), the detector 103 further detects the sheet feeding cassette 141 or the manual feeding tray 128 used for a current image formation (S21). Then, the mode determining section 104 reads out from the mode storing section 111 a mode (the image formation preceding mode or the sheet conveyance preceding mode) set for a combination of the magenta toner image forming unit 12M and the detected sheet feeding cassette 141 or the manual feeding tray 128, and determines the mode (S3). The drive controller 101 performs later image forming processings in the determined mode (S4 to S9).

According to the another embodiment, timings of a toner image and a recording sheet arriving at the toner image transferring position of the secondary transferring device 113 can be adjusted more assuredly based on a distance relationship between a distance A from the toner image forming unit detected by the detector 103 to the toner image transferring position of the secondary transferring device 113 and a distance C from the sheet feeding cassette 141 or the manual feeding tray 128 used for an image forming to the toner image transferring position of the secondary transferring device 113.

Further, as described above, in the complex machine 1, a peripheral speed of the driving roller 125*a* (a running speed of the intermediate transferring belt 125) and a peripheral speed of the roller of the secondary transferring device 113 are set to be the same, and a recording sheet conveying speed by the pair of conveying rollers 112 and the registration roller 150 is set to be the same speed as of a recording conveying speed by nipping of the driving roller 125*a* and the roller of the secondary transferring device 113. Accordingly, in the another embodiment, as a mode to be set for each toner image forming unit, (1) the image formation preceding mode is stored in the mode storing section 111 when a time period for conveying a toner image by the intermediate transferring belt 125 from each toner image forming unit to the toner image transferring position of the secondary transferring device 113 is longer than a time length for conveying the recording sheet by the recording sheet conveying section 131 from the sheet feeding cassette 141 or the manual feeding tray 128, or (2) the sheet conveyance preceding mode is stored in the mode storing section 111 when the time length for conveying the toner image by the intermediate transferring belt 125 from each toner image forming unit to the toner image transferring position of the secondary transferring device 113 is shorter than the time length for conveying the recording sheet by the recording sheet conveying section 131 from the sheet feeding cassette 141 or the manual feeding tray 128.

Further, in the mode storing section 111, as a mode to be set for each toner image forming unit, there may be stored the image forming mode which is determined based on a distance relationship between a time length for conveying a toner image by the intermediate transferring belt 125 from each toner image forming unit to the toner image transferring position of the secondary transferring device 113 and a time length for conveying the recording sheet by the recording sheet conveying section 131 from the sheet feeding cassette 141 or the manual feeding tray 128, regardless of a distance relationship between a distance A from an toner image forming unit detected by the detector 103 to the toner image transferring position of the secondary transferring device 113 and a distance C from the sheet feeding cassette 141 or the manual feeding tray 128 used for an image formation to the toner image transferring position of the secondary transferring device 113.

Figure 5:
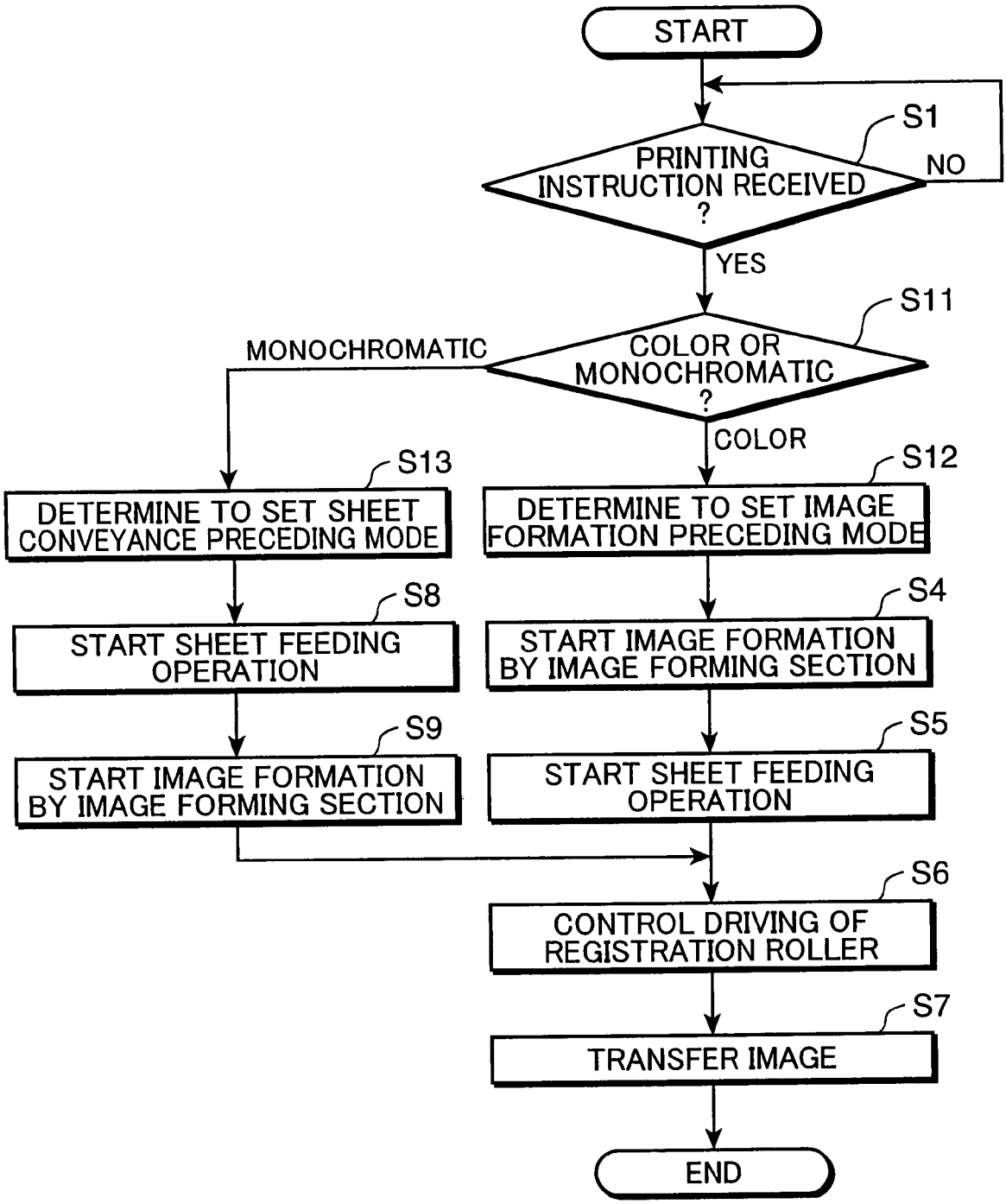
FIG. 5 is a flowchart showing further another embodiment of the image forming processing performed by the complex machine.

FIG. 5 is, a flowchart showing further another embodiment of the image forming processing performed by the complex machine 1. It should be noted that descriptions of processings which are the same as those of the embodiment according to FIG. 3 is omitted.

In the complex machine 1, when the instruction reception portion 102 receives a printing instruction from an operator through an operation of the operation panel 118 (YES in S1), the detector 103 detects whether the image forming operation indicated by the image forming instruction is a color image formation or a monochromatic image formation (S11).

When the detector 103 detects a color image forming instruction ("color" in S11), the mode determining section determines the image formation preceding mode (S12), and the drive controller 101 controls the respective toner image forming units 12C, 12M, 12Y, 12K and the exposing device 124 to start performing an image operation before the sheet conveying section 131 starts feeding a recording sheet from the sheet feeding cassette 141 (S4). When the image formation performed by the respective toner image forming units 12C, 12M, 12Y, 12K and the exposing device 124 is proceeded to the predetermined step, the drive controller 101 controls the sheet conveying section 131 to start performing a sheet feeding operation from the sheet feeding cassette 141 (S5).

Further, when the detector 103 detects a monochromatic image forming instruction ("monochromatic" in S11), the mode determining section determines the sheet conveyance preceding mode (S13), and the drive controller 101 controls the sheet conveying section 131 to start feeding a recording sheet from the sheet feeding cassette 141 before the respective toner image forming units 12C, 12M, 12Y, 12K and the exposing device 124 performs an image forming operation (S8). When the conveyance of the recording sheet from the sheet feeding cassette 141 is proceeded to the predetermined position, the drive controller 101 controls the toner image forming units and the exposing device 124 to start the image forming operation (S9).

By performing such processings, a time required for completing a transfer of a toner image to a recording sheet can be shortened, and waste toner particles can be reduced according to which one of the color image formation and the monochromatic image formation is performed.

Further, the present invention is not limited to the above-described embodiments but can be modified in various manners. In the above-described embodiments, (1) the image formation preceding mode is set to be a mode of starting the image forming operation performed by the toner image forming units 12C, 12M, 12Y, 12K and the exposing device 124 is performed before the sheet conveying section 131 conveys a recording sheet from the sheet feeding cassette 141, and (2) the sheet conveyance preceding mode is set to be a mode of making the sheet conveying section 131 start conveying a recording sheet from the sheet feeding cassette 141 before an image formation is performed by one or more toner image forming units among the toner image forming units 12C, 12M, 12Y, 12K and the exposing device 124. However, for example, a control of making the image forming operation and the sheet feeding operation performed at the same time can be included in any one of the (1) image formation preceding mode or (2) the sheet conveyance preceding mode.

In summary, the present invention includes An image forming apparatus comprising: a sheet storage section for storing recording sheets; a sheet feeder for taking out and conveying a recording sheet from the sheet storage section; an image forming section including: a plurality of toner image forming devices for forming a monochromatic and color toner image, the toner image forming devices facing an image bearing member; the image bearing member for bearing a formed toner image transferred from a toner image forming device; and a transferring device for transferring the toner image formed on the image bearing member to a recording sheet conveyed by the sheet feeder; a drive controller for controlling drivings of the sheet feeder and the image forming section; an instruction reception section for allowing an operator to selectively instruct forming of a toner image on a recording sheet; a mode storing section for storing an image formation preceding mode of making the toner image forming devices start their respective toner image forming operations before the sheet feeder performs conveyance of a recording sheet from the sheet storage section, and a sheet conveyance preceding mode of making the toner image forming devices start their respective image forming operations after the sheet feeder performs conveyance of a recording sheet from the sheet storage section; and a mode determining section for determining, based on which one of the plurality of image forming devices is driven according to an operator's instruction to the instruction reception section, one of the image formation preceding mode and the sheet conveyance preceding mode stored in the mode storing section. The drive controller controls the drivings of the sheet feeder and the image forming section according to the mode determined by the mode determining section.

According to the invention, when the instruction reception receives an image forming instruction from an operator, the mode determining section determines, based on which one of the plurality of image forming devices is driven according to the image forming instruction, one of the image formation preceding mode and the sheet conveyance preceding mode as an image forming mode to be set for each of the image forming devices. Thus, according to a position where a toner image is transferred from the image forming device to the image bearing member, arrival timings of the toner image and the recording sheet to the position where the toner image is transferred from the image bearing member to the recording sheet can be adjusted to an efficient arrival timing in terms of time which does not cause waiting time for both the recording sheet and the toner image. For example, when it is assumed that a toner image arrives at the transferring position earlier in view of a position of a toner image forming device performing an image forming operation if a toner image formation and a sheet feeding are started at the same time, the sheet conveyance preceding mode is set so that delay in arrival of a recording sheet to the transferring position can be prevented. Accordingly, reduction of waste toner image can be achieved. Further, when it is assumed that a recording sheet arrives at the transferring position earlier in view of a position of a toner image forming device performing an image forming operation if a toner image formation and a sheet feeding are started at the same time, the image formation preceding mode is set so that a time required for transferring a toner image to a recording sheet from the start time of the image forming operation.

Further, the present invention the present invention further comprises a detector for detecting, among toner image forming devices in connection with the operator's instruction, a toner image forming device located at a position having a longest distance to the transferring device on the moving course of the image bearing member. The mode storing section stores the image formation preceding mode or the sheet conveyance preceding mode set for each of the plurality of toner image forming devices. The mode determining section reads out from the mode storing section a mode set for the image forming device detected by the detector, and determines the mode read out by the mode determining section as an image forming mode for controlling drivings of the sheet feeder and the image forming section.

According to the invention, when an image forming instruction from the operator is received by the instruction reception section, the detector detects, among toner image forming devices in connection with the operator's instruction, an image forming device located at a position having a longest distance to the transferring device on the moving course of the image bearing member. The mode determining section determines which one of the image formation preceding mode and the sheet conveyance preceding mode is set for the image forming device detected by the detector, and the drive controller controls drivings of the sheet feeder and the image forming section in the mode determined by the mode determining section. Thus, according to a position of an image forming device which is assumed to cause a longest time for the image bearing member to convey the toner image to the transferring position of the transferring device, arrival timings of the toner image and the recording sheet to the transferring position where the toner image is transferred from the image bearing member to the recording sheet can be adjusted to an efficient timing in terms of time.

Furthermore, according to the invention, the image formation preceding mode is set for a toner image forming device having a longer distance to an image transferring position of the image transferring device than a distance from the sheet storing section to the image transferring position of the transferring device, and the sheet conveyance preceding mode is set for a toner image forming device having a shorter distance from the image transferring position of the image transferring device than the distance from the sheet storing section to the image transferring position of the transferring device.

According to the invention, when it is assumed, based on a distance from the image forming device to the image transferring position of the image transferring device, that a toner image formed on the image bearing member by the image forming device arrives at the toner image transferring position of the image transferring device later than a recording sheet conveyed by the sheet feeder, the image formation preceding mode is set for the image forming device. Accordingly, the time required from the start of toner image formation to the image bearing member and the sheet feeding to the completion of transferring the toner image to the recording sheet can be shortened. On the other hand, when it is assumed that the toner image formed on the image bearing member by the image forming device arrives at the toner image transferring position of the transferring device earlier than a recording sheet conveyed by the sheet feeder if the image formation and the sheet feeding are performed at the same time, the recording sheet preceding mode is set so that delay in arrival of the recording sheet to the toner image transferring position can be prevented. Accordingly, a possibility that the toner image formed on the image bearing member can be assuredly transferred to the recording sheet is raised, thereby reducing the amount of waste toner particles.

Further, according to the invention, the image formation preceding mode is set for a toner image forming device when a time length for conveying a toner image on the moving course of the image bearing member from the image forming device to the toner image transferring position of the transferring device is longer than a time length for conveying a recording sheet by the sheet feeder to the image transferring position of the transferring device, and the sheet conveyance preceding mode is set for a toner image forming device when the time length for conveying the toner image on the moving course of the image bearing member from the image forming device to the toner image transferring position of the transferring device is shorter than the time length for conveying a recording sheet by the sheet feeder to the image transferring position of the transferring device.

According to the invention, if the image formation and the sheet feeding are performed at the same time, whether the sheet feeding of a recording sheet is started in advance or the image formation is started in advance is controlled based on which one of the toner image and the recording sheet arrives earlier at the toner image transferring position of transferring device. Accordingly, under the aforementioned condition, the sheet conveyance preceding mode is set when the toner image arrives at the transferring position earlier. Thus, delay in arrival of the recording sheet to the transferring position is prevented so that reduction of waste toner image can be achieved. Further, under the aforementioned condition, the image formation preceding mode is set when the recording sheet arrives at the transferring position earlier. Thus, the waiting time of the recording sheet before the transferring position can be reduced so that the time required for transferring the toner image can be shortened. Consequently, both shortening of the time required for completing the transfer of toner image to the recording sheet and the reduction of waste toner amount can be achieved.

Further, according to the invention, the sheet storage section includes a plurality of sheet storage portions. The mode storing section stores the image formation preceding mode or the sheet conveyance preceding mode which is set for each of the plurality of toner image forming devices in consideration of their distance relationships to the plurality of sheet storing portions. The detector detects, among the sheet storage portions, a sheet storing portion in connection with the operator's instruction. The mode determining section reads out from the mode storing section a mode which is set for the image forming device detected by the detector, the mode being in connection with the sheet storing portion detected by the detector, and determines the mode as an image forming mode to be applied at the time of controlling drivings of the sheet feeder and the image forming section.

According to the invention, based on the distance relationship between the distance from a toner image forming unit used for the image formation to the toner image transferring position of the transferring device and the distance from an actual sheet storing portion to the toner image transferring position of the transferring device, or based on the time relationship between the time length for conveying a toner image from an toner image forming unit used for the image formation to the toner image transferring position of the transferring device and the time length for conveying a recording sheet by the sheet feeder from an actual sheet storing portion used for the image formation to the toner image transferring position of the transferring device, the arrival timing of a toner image and a recording sheet to the toner image transferring position of the transferring device can be adjusted.

Further, according to the invention, among the toner image forming devices in the image forming section, an image forming device for forming a monochromatic image is located at a position having a shortest distance to the transferring device on the moving course of the image bearing member. The image forming apparatus further comprises a detector for detecting whether an image forming instruction received by the instruction receiving section is an instruction for forming a monochromatic image or a color image. The mode determining section determines an image forming mode for controlling drivings of the sheet feeder and the image forming mechanism to be the sheet conveyance preceding mode when it is detected that the detector detects an instruction to form a monochromatic image, or the mode determining section determines an image forming mode to be the image formation preceding mode when the detector detects an instruction to form a color image.

According to the invention, if the toner image formation and the sheet feeding are started at the same time, the sheet conveyance preceding mode is set in the case of the monochromatic image formation where it is assumed that a toner image arrives at the transferring position in advance. Accordingly, delay in arrival of a recording sheet to the transferring position is prevented, thereby reducing waste toner image. Further, the image formation preceding mode is set in the case of the color image formation where it is assumed that a recording sheet arrives at the transferring position in advance. Accordingly, waiting time of a recording sheet before the transferring position is reduced, thereby shortening the time required for transferring a toner image.

The invention further comprises a registration device provided in a sheet conveying passage on upstream side in a recording sheet conveying direction from the transferring device and adapted for continuing or suspending a conveyance of a recording sheet conveyed by the sheet feeder. The drive controller controls driving of the registration device and adjusts an arrival timing of a recording sheet conveyed by the sheet feeder to the transferring position of the monochromatic image or a color image by the transferring device.

According to the invention, the drive controller controls driving of the registration device. Accordingly, by temporarily suspending a conveyance of a recording sheet on upstream in a sheet conveyance direction from the toner image transferring position of the transferring device, arrival timings of a recording sheet conveyed by the sheet feeder and the toner image to the toner image transferring position of the transferring device can be assuredly adjusted.

This application is based on Japanese Patent application serial Nos. 2006-116006 and 2006-116007 both filed in Japan Patent Office on Apr. 19, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a sheet storage section for storing recording sheets;

a sheet feeder for taking out and conveying a recording sheet from the sheet storage section;

an image forming section including:

a plurality of toner image forming devices for forming a monochromatic and color toner image, the toner image forming devices facing an image bearing member;

the image bearing member for bearing a formed toner image transferred from a toner image forming device; and a transferring device for transferring the toner image formed on the image bearing member to a recording sheet conveyed by the sheet feeder, wherein among the toner image forming devices in the image forming section, an image forming device for forming a monochromatic image is located at a position having a shortest distance to the transferring device on a moving course of the image bearing member;

a drive controller for controlling drivings of the sheet feeder and the image forming section;

an instruction reception section for allowing an operator to selectively instruct forming of a toner image on a recording sheet;

a mode storing section for storing an image formation preceding mode of making the toner image forming devices start their respective toner image forming operations before the sheet feeder performs conveyance of a recording sheet from the sheet storage section, and a sheet conveyance preceding mode of making the toner image forming devices start their respective image forming operations after the sheet feeder performs conveyance of a recording sheet from the sheet storage section;

a detecting section for detecting whether an image forming instruction received by said instruction reception section is an instruction for forming a monochromatic image or a color image;

a mode determining section which determines to set the image formation preceding mode when said detecting section detects a color image forming instruction where a recording sheet arrives at the transferring position in advance if the toner image formation and the sheet feeder are started at the same time so as to reduce a waiting time of a recording sheet before the transferring position, thereby shortening the time required for transferring a toner image, while determining to set the sheet conveyance preceding mode when said detecting section detects a monochrome image forming instruction where the toner image arrives at the transferring position in advance if the toner image formation and the sheet feeder are started at the same time so as to prevent a delay in arrival of the recording sheet to the transferring position, thereby reducing waste toner image; and a registration device provided in a sheet conveying passage on upstream side in a recording sheet conveying direction from the transferring device and adapted for continuing or suspending a conveyance of a recording sheet conveyed by the sheet feeder;

wherein the drive controller controls the drivings of the sheet feeder and the image forming section according to the mode determined by the mode determining section and controls driving of the registration device to adjust an arrival timing of the recording sheet conveyed by the sheet feeder to the transferring position according to the mode determined by the mode determining section.

2. The image forming apparatus according to claim 1, further comprising a detector for detecting, among toner image forming devices in connection with the operator's instruction, a toner image forming device located at a position having a longest distance to the transferring device on the moving course of the image bearing member, wherein the mode storing section stores the image formation preceding mode or the sheet conveyance preceding mode set for each of the plurality of toner image forming devices, wherein the mode determining section reads out from the mode storing section a mode set for the image forming device detected by the detector, and determines the mode read out by the mode determining section as an image forming mode for controlling drivings of the sheet feeder and the image forming section.

3. The image forming apparatus according to claim 2, wherein the image formation preceding mode is set for a toner image forming device having a longer distance to an image transferring position of the image transferring device than a distance from the sheet storing section to the image transferring position of the transferring device; and the sheet conveyance preceding mode is set for a toner image forming device having a shorter distance from the image transferring position of the image transferring device than the distance from the sheet storing section to the image transferring position of the transferring device.

4. The image forming apparatus according to claim 3, wherein the sheet storage section includes a plurality of sheet storage portions;

wherein the mode storing section stores the image formation preceding mode or the sheet conveyance preceding mode which is set for each of the plurality of toner image forming devices in consideration of their distance relationships to the plurality of sheet storing portions;

wherein the detector detects, among the sheet storage portions, a sheet storing portion in connection with the operator's instruction; and the mode determining section reads out from the mode storing section a mode which is set for the image forming device detected by the detector, the mode being in connection with the sheet storing portion detected by the detector, and determines the read mode as an image forming mode to be applied at the time of controlling drivings of the sheet feeder and the image forming section.

5. The image forming apparatus according to claim 2, wherein the image formation preceding mode is set for a toner image forming device when a time length for conveying a toner image on the moving course of the image bearing member from the image forming device to the toner image transferring position of the transferring device is longer than a time length for conveying a recording sheet by the sheet feeder to the image transferring position of the transferring device; and wherein the sheet conveyance preceding mode is set for a toner image forming device when the time length for conveying the toner image on the moving course of the image bearing member from the image forming device to the toner image transferring position of the transferring device is shorter than the time length for conveying a recording sheet by the sheet feeder to the image transferring position of the transferring device.

6. The image forming apparatus according to claim 5, wherein the sheet storage section includes a plurality of sheet storage portions;

wherein the mode storing section stores the image formation preceding mode or the sheet conveyance preceding mode which is set for each of the plurality of toner image forming devices in consideration of their distance relationships to the plurality of sheet storing portions;

wherein the detector detects, among the sheet storage portions, a sheet storing portion in connection with the operator's instruction; and the mode determining section reads out from the mode storing section a mode which is set for the image forming device detected by the detector, the mode being in connection with the sheet storing portion detected by the detector and determines the read mode as an image forming mode to be applied at the time of controlling drivings of the sheet feeder and the image forming section.

* * * * *